US006450619B1

(12) United States Patent
Anagnostopoulos et al.

(10) Patent No.: US 6,450,619 B1
(45) Date of Patent: Sep. 17, 2002

(54) CMOS/MEMS INTEGRATED INK JET PRINT HEAD WITH HEATER ELEMENTS FORMED DURING CMOS PROCESSING AND METHOD OF FORMING SAME

(75) Inventors: Constantine N. Anagnostopoulos, Mendon; John A. Lebens, Rush; Gilbert A. Hawkins, Mendon; David P. Trauernicht, Rochester; James M. Chwalek, Pittsford; Christopher N. Delametter, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/792,188

(22) Filed: Feb. 22, 2001

(51) Int. Cl.[7] ..... B41S 2/05; B41S 2/09
(52) U.S. Cl. ..... 347/59; 347/77
(58) Field of Search ..... 347/78, 82, 47, 347/63, 59; 216/27; 438/21

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,946,398 A | | 3/1976 | Kyser et al. | |
| 4,346,387 A | | 8/1982 | Hertz | |
| 5,880,759 A | | 3/1999 | Silverbrook | |
| 5,963,235 A | * | 10/1999 | Chwalek et al. | 347/82 |
| 5,966,154 A | * | 10/1999 | DeBoer | 347/82 |
| 6,079,821 A | | 6/2000 | Chwalek et al. | |
| 6,130,688 A | * | 10/2000 | Agarwal et al. | 347/47 |

FOREIGN PATENT DOCUMENTS

GB 2007162 A 10/1978

OTHER PUBLICATIONS

U.S. patent application Ser. No. 09/451,790, Trauernicht et al, filed Dec. 1, 1999.
U.S. patent application Ser. No. 09/470,638, Delametter et al, filed Dec. 22, 1999.
U.S. patent application Ser. No. 09/466,346, Jeanmaire et al, filed Dec. 17, 1999 (now U.S. Pat. No. 6,203,145).
U.S. patent application Ser. No. 09/221,256, Anagnostopoulos et al, filed Dec. 28, 1998.
U.S. patent application Ser. No. 09/221,342, Anagnostopoulos et al, filed Dec. 28, 1998.

* cited by examiner

*Primary Examiner*—John Barlow
*Assistant Examiner*—Michael S. Brooke
(74) *Attorney, Agent, or Firm*—Norman Rushefsky

(57) ABSTRACT

A continuous ink jet print head is formed of a silicon substrate that includes integrated circuits formed therein for controlling operation of the print head. An insulating layer or layers overlies the silicon substrate and has a series or an array of nozzle openings or bores formed therein along the length of the substrate and each nozzle opening is formed in a recess in the insulating layer or layers by a material depletion process such as etching. The process of etching defines the nozzle openings at locations where heater elements are formed in the insulating layer or layers during a conventional CMOS processing of the integrated circuits. The print head structure thereby provides for minimal post processing of the print head after the completion of the CMOS processing.

29 Claims, 17 Drawing Sheets

CM OS/MEMS INTEGRATED INK JET PRINT HEAD WITH HEATER ELEMENTS FORMED DURING CMOS PROCESSING AND METHOD OF FORMING SAME

FIELD OF THE INVENTION

This invention generally relates to the field of digitally controlled printing devices, and in particular to liquid ink print heads which integrate multiple nozzles on a single substrate and in which a liquid drop is selected for printing by thermo-mechanical means.

BACKGROUND OF THE INVENTION

Ink jet printing has become recognized as a prominent contender in the digitally controlled, electronic printing arena because, e.g., of its non-impact, low noise characteristics and system simplicity. For these reasons, ink jet printers have achieved commercial success for home and office use and other areas.

Ink jet printing mechanisms can be categorized as either continuous (CIJ) or Drop-on-Demand (DOD). U.S. Pat. No. 3,946,398, which issued to Kyser et al. in 1970, discloses a DOD ink jet printer which applies a high voltage to a piezoelectric crystal, causing the crystal to bend, applying pressure on an ink reservoir and jetting drops on demand. Piezoelectric DOD printers have achieved commercial success at image resolutions greater than 720 dpi for home and office printers. However, piezoelectric printing mechanisms usually require complex high voltage drive circuitry and bulky piezoelectric crystal arrays, which are disadvantageous in regard to number of nozzles per unit length of print head, as well as the length of the print head. Typically, piezoelectric print heads contain at most a few hundred nozzles.

Great Britain Patent No. 2,007,162, which issued to Endo et al., in 1979, discloses an electrothermal drop-on-demand ink jet printer that applies a power pulse to a heater which is in thermal contact with water based ink in a nozzle. A small quantity of ink rapidly evaporates, forming a bubble, which causes a drop of ink to be ejected from small apertures along an edge of a heater substrate. This technology is known as thermal ink jet or bubble jet.

Thermal ink jet printing typically requires that the heater generates an energy impulse enough to heat the ink to a temperature near 400° C. which causes a rapid formation of a bubble. The high temperatures needed with this device necessitate the use of special inks, complicates driver electronics, and precipitates deterioration of heater elements through cavitation and kogation. Kogation is the accumulation of ink combustion by-products that encrust the heater with debris. Such encrusted debris interferes with the thermal efficiency of the heater and thus shorten the operational life of the print head. And, the high active power consumption of each heater prevents the manufacture of low cost, high speed and page wide print heads.

Continuous ink jet printing itself dates back to at least 1929. See U.S. Pat. No. 1,941,001 which issued to Hansell that year.

U.S. Pat. No. 3,373,437 which issued to Sweet et al. in March 1968, discloses an array of continuous ink jet nozzles wherein ink drops to be printed are selectively charged and deflected towards the recording medium. This technique is known as binary deflection continuous ink jet printing, and is used by several manufacturers, including Elmjet and Scitex.

U.S. Pat. No. 3,416,153, issued to Hertz et al. in December 1968. This patent discloses a method of achieving variable optical density of printed spots, in continuous ink jet printing. The electrostatic dispersion of a charged drop stream serves to modulatate the number of droplets which pass-through a small aperture. This technique is used in ink jet printers manufactured by Iris.

U.S. Pat. No. 4,346,387, entitled METHOD AND APPARATUS FOR CONTROLLING THE ELECTRIC CHARGE ON DROPLETS AND INK JET RECORDER INCORPORATING THE SAME issued in the name of Carl H. Hertz on Aug. 24, 1982. This patent discloses a CIJ system for controlling the electrostatic charge on droplets. The droplets are formed by breaking up of a pressurized liquid stream, at a drop formation point located within an electrostatic charging tunnel, having an electrical field. Drop formation is effected at a point in the electrical field corresponding to whatever predetermined charge is desired. In addition to charging tunnels, deflection plates are used to actually deflect the drops. The Hertz system requires that the droplets produced be charged and then deflected into a gutter or onto the printing medium. The charging and deflection mechanisms are bulky and severely limit the number of nozzles per print head.

Until recently, conventional continuous ink jet techniques all utilized, in one form or another, electrostatic charging tunnels that were placed close to the point where the drops are formed in the stream. In the tunnels, individual drops may be charged selectively. The selected drops are charged and deflected downstream by the presence of deflector plates that have a large potential difference between them. A gutter (sometimes referred to as a "catcher") is normally used to intercept the charged drops and establish a non-print mode, while the uncharged drops are free to strike the recording medium in a print mode as the ink stream is thereby deflected, between the "non-print" mode and the "print" mode.

Typically, the charging tunnels and drop deflector plates in continuous ink jet printers operate at large voltages, for example a 100 volts or more, compared to the voltage commonly considered damaging to conventional CMOS circuitry, typically 25 volts or less. Additionally, there is a need for the inks in electrostatic continuous ink jet printers to be conductive and to cany current. As is well known in the art of semiconductor manufacture, it is undesirable from the point of view of reliability to pass current bearing liquids in contact with semiconductor surfaces. Thus the manufacture of continuous ink jet print heads has not been generally integrated with the manufacture of CMOS circuitry.

Recently, a novel continuous ink jet printer system has been developed which renders the above-described electrostatic charging tunnels unnecessary. Additionally, it serves to better couple the functions of (1) droplet formation and (2) droplet deflection. That system is disclosed in the commonly assigned U.S. Pat. No. 6,079,821 entitled CONTINUOUS INK JET PRINTER WITH ASYMMETRIC HEATING DROP DEFLECTION filed in the names of James Chwalek, Dave Jeanmaire and Constantine Anagnostopoulos, the contents of which are incorporated herein by reference. This patent discloses an apparatus for controlling ink in a continuous ink jet printer. The apparatus comprises an ink delivery channel, a source of pressurized ink in communication with the ink delivery channel, and a nozzle having a bore which opens into the ink delivery channel, from which a continuous stream of ink flows. Periodic application of weak heat pulses to the stream by a heater causes the ink stream to break up into a plurality of droplets synchronously with the applied heat pulses and at a position spaced from the nozzle. The droplets are deflected by increased heat pulses from the heater (in the nozzle bore) which heater has a selectively actuated section, i.e. the section associated with only a portion of the nozzle bore. Selective actuation of a particular heater section, constitutes what has been termed an asymmetrical application of heat to the stream. Alternating the sections can, in turn, alternate the direction in which this asymmetrical heat is supplied and serves to thereby deflect ink drops, inter alia, between a "print" direction (onto a recording medium) and a "non-print" direction (back into a "catcher"). The patent of Chwalek et al. thus provides a liquid printing system that affords significant improvements toward overcoming the prior art problems associated with the number of nozzles per print head, print head length, power usage and characteristics of useful inks.

Asymmetrically applied heat results in stream deflection, the magnitude of which depends upon several factors, e.g. the geometric and thermal properties of the nozzles, the quantity of applied heat, the pressure applied to, and the physical, chemical and thermal properties of the ink. Although solvent-based (particularly alcohol-based) inks have quite good deflection patterns (see in this regard U.S. application Ser. No. 09/451,790 filed in the names of Trauernicht et al. on Dec. 1, 1999), and achieve high image quality in asymmetrically heated continuous ink jet printers, water-based inks are more problematic. The water-based inks do not deflect as much, thus their operation is not as robust. In order to improve the magnitude of the ink droplet deflection within continuous ink jet asymmetrically heated printing systems there is disclosed in commonly assigned U. S. application Ser. No. 09/470,638 filed Dec. 22, 1999 in the names of Delametter et al. a continuous ink jet printer having improved ink drop deflection, particularly for aqueous based inks, by providing enhanced lateral flow characteristics, by geometric obstruction within the ink delivery channel.

The invention to be described herein builds upon the work of Chwalek et al. and Delametter et al. in terms of constructing continuous ink jet printheads that are suitable for low-cost manufacture and preferably for printheads that can be made page wide.

Although the invention may be used with ink jet print heads that are not considered to be page wide print heads there remains a widely recognized need for improved ink jet printing systems, providing advantages for example, as to cost, size, speed, quality, reliability, small nozzle orifice size, small droplets size, low power usage, simplicity of construction in operation, durability and manufacturability. In this regard, there is a particular long-standing need for the capability to manufacture page wide, high resolution ink jet print heads. As used herein, the term "page wide" refers to print heads of a minimum length of about four inches. High-resolution implies nozzle density, for each ink color, of a minimum of about 300 nozzles per inch to a maximum of about 2400 nozzles per inch.

To take full advantage of page wide print heads with regard to increased printing speed they must contain a large number of nozzles. For example, a conventional scanning type print head may have only a few hundred nozzles per ink color. A four inch page wide printhead, suitable for the printing of photographs, should have a few thousand nozzles. While a scanned printhead is slowed down by the need for mechanically moving it across the page, a page wide printhead is stationary and paper moves past it. The image can theoretically be printed in a single pass, thus substantially increasing the printing speed.

There are two major difficulties in realizing page wide and high productivity ink jet print heads. The first is that nozzles have to be spaced closely together, of the order of 10 to 80 micrometers, center to center spacing. The second is that the drivers providing the power to the heaters and the electronics controlling each nozzle must be integrated with each nozzle, since attempting to make thousands of bonds or other types of connections to external circuits is presently impractical.

One way of meeting these challenges is to build the print heads on silicon wafers utilizing VLSI technology and to integrate the CMOS circuits on the same silicon substrate with the nozzles.

While a custom process, as proposed in the patent to Silverbrook, U.S. Pat. No. 5,880,759 can be developed to fabricate the print heads, from a cost and manufacturability point of view it is preferable to first fabricate the circuits and nozzles using a nearly standard CMOS process in a conventional VLSI facility. Then, to post process the wafers in a separate MEMS (micro-electromechanical systems) facility for the fabrication of the ink channels.

SUMMARY OF THE INVENTION

It is therefore an object of the invention to provide a CIJ printhead that may be fabricated at lower cost and improved manufacturability as compared to those ink jet printheads known in the prior art that require more custom processing.

It is another object of the invention to provide a CIJ printhead that features heater elements and bores that are formed during the CMOS processing and thereby reduces the cost and number of post process steps in a MEMS facility.

In accordance with a first aspect of the invention there is provided an ink jet print head comprising a silicon substrate including an integrated circuit formed therein for controlling operation of the print head, the silicon substrate having one or more ink channels formed therein along the substrate; an insulating layer or layers overlying the silicon substrate, the insulating layer or layers having a series of ink jet nozzle bores each formed in a respective recess of the insulating layer or layers, the recess being formed by an etching or other material depletion process and each bore communicates with an ink channel; and each bore having located proximate thereto a heater element formed prior to the material depletion process for forming the recess so that upon forming the recess each heater element is covered by material from the insulating layer or layers.

In accordance with a second aspect of the invention, there is provided an ink jet print head comprising a silicon substrate including an integrated circuit formed therein for controlling operation of the print head; an insulating layer or layers overlying the silicon substrate, the insulating layer or layers having a series of ink jet nozzle bores each formed in a respective recess of the insulating layer or layers; a heater element formed of polysilicon in each recess area adjacent each bore.

In accordance with a third aspect of the invention, there is provided a method of operating a continuous ink jet print head comprising providing liquid ink under pressure in an ink channel formed in a silicon substrate, the substrate having a series of integrated circuits formed therein for controlling operation of the print head; asymmetrically heating the ink at a nozzle opening to affect deflection of ink droplet(s), each nozzle opening communicating with an ink channel and the nozzle openings being arranged as an array extending in a predetermined direction; and wherein each nozzle opening is formed in a respective recess in an insulating layer or layers covering the silicon substrate and a heater element is associated with each nozzle opening and located in the recess.

In accordance with a fourth aspect of the invention, there is provided a method of forming a continuous ink jet print head comprising providing a silicon substrate having an integrated circuit for controlling operation of the print head, the silicon substrate having an insulating layer or layers formed thereon, the insulating layer or layers having electrical conductors and heating elements formed therein that are electrically connected to the circuit formed in the silicon substrate; and forming in the insulating layer or layers a series or array of ink jet bores in a straight line or staggered configuration each in a respective recess in the insulating layer or layers, wherein each bore is formed at a location proximate a heating element.

These and other objects, features and advantages of the present invention will become apparent to those skilled in the art upon reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings.

DETAILED DESCRIPTION OF THE INVENTION

This description will be directed in particular to elements forming part of, or cooperating more directly with, apparatus in accordance with the present invention. It is to be understood that elements not specifically shown or described may take various forms well known to those skilled in the art.

Figure 13:
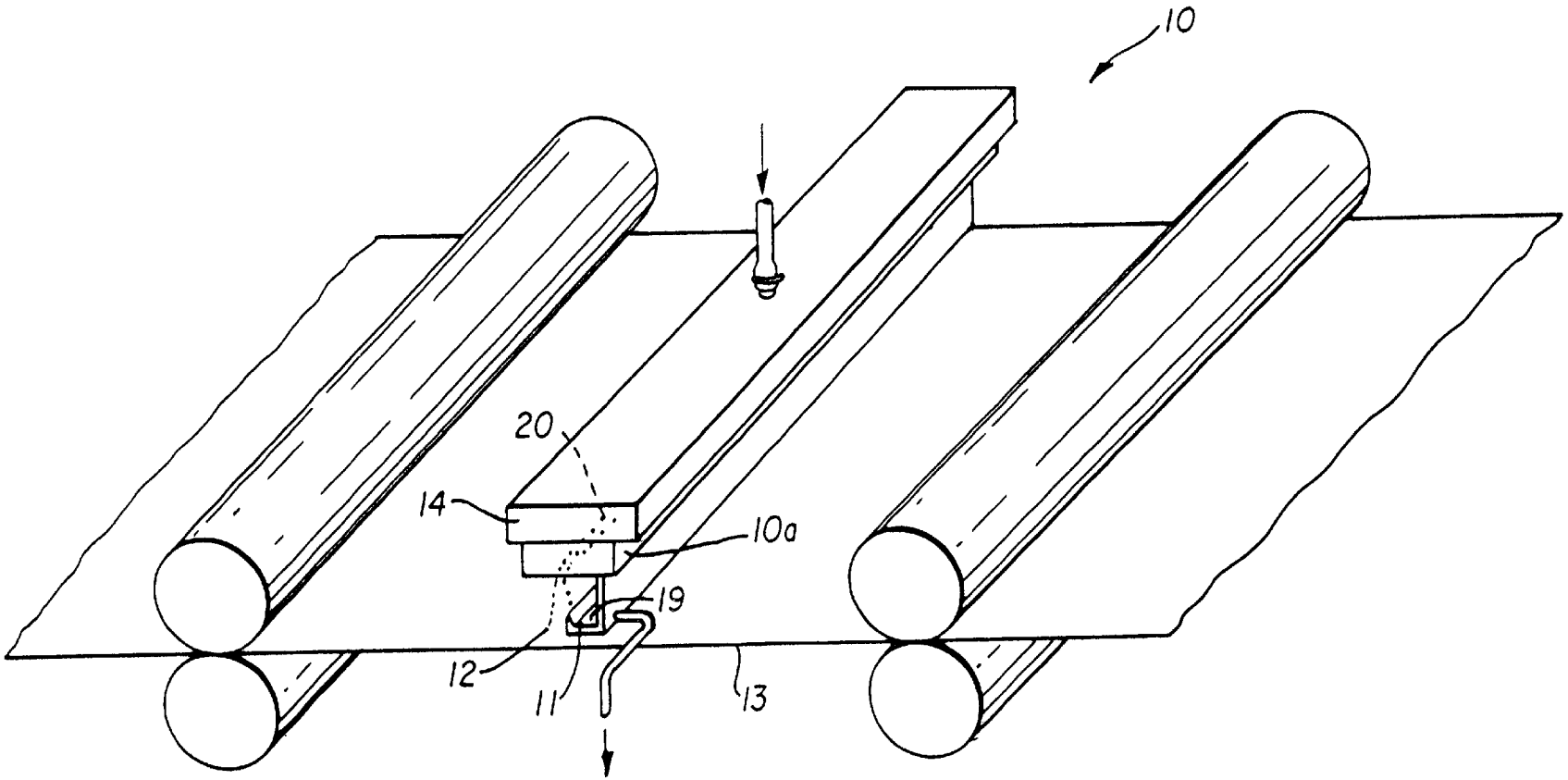
FIG. 13 illustrates a schematic diagram of an exemplary continuous ink jet print head and nozzle array as a print medium (e.g. paper) rolls or is transported under the ink jet print head.

Referring to FIG. 13, a continuous ink jet printer system is generally shown at 10. The printhead 10*a*, from which extends an array of nozzles 20, incorporating heater control circuits (not shown).

Heater control circuits read data from an image memory, and send time-sequenced electrical pulses to the heaters of the nozzles of nozzle array 20. These pulses are applied an appropriate length of time, and to the appropriate nozzle, so that drops formed from a continuous ink jet stream will form spots on a recording medium 13, in the appropriate position designated by the data sent from the image memory. Pressurized ink travels from an ink reservoir (not shown) to an ink delivery channel, built inside member 14 and through nozzle array 20 on to either the recording medium 13 or the gutter 19. The ink gutter 19 is configured to catch undeflected ink droplets 11 while allowing deflected droplets 12 to reach a recording medium. The general description of the continuous ink jet printer system of FIG. 13 is also suited for use as a general description in the printer system of the invention.

Figure 1:
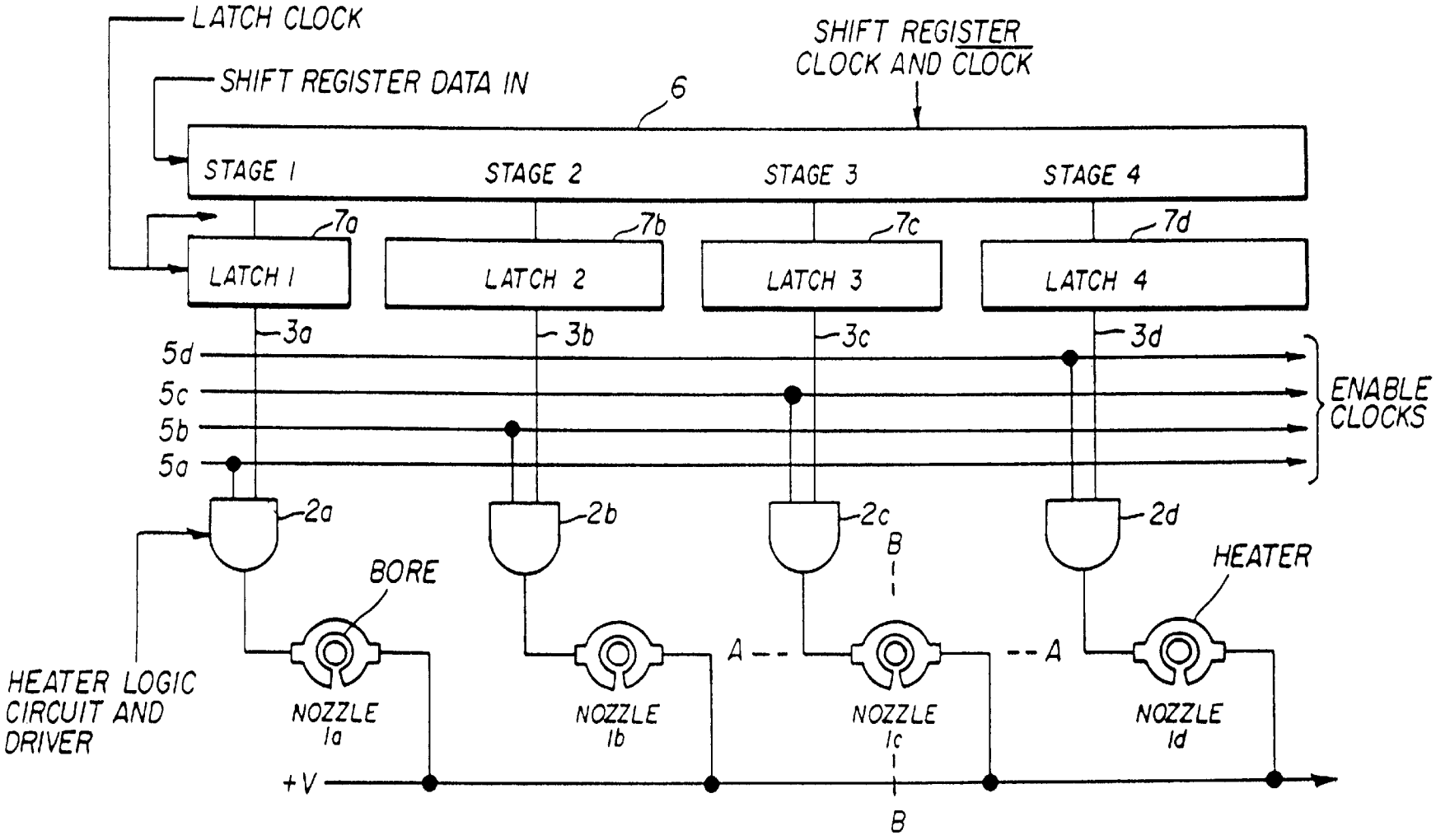
FIG. 1 is a schematic and fragmentary top view of a print head constructed in accordance with the present invention.

Referring to FIG. 1, there is shown a top view of an ink jet print head according to the teachings of the present invention. The print head comprises an array of nozzles 1*a*–1*d* arranged in a line or a staggered configuration. Each nozzle is addressed by a logic AND gate (2*a*–2*d*) each of which contains logic circuitry and a heater driver transistor (not shown). The logic circuitry causes a respective driver transistor to turn on if a respective signal on a respective data input line (3*a*–3*d*) to the AND gate (2*a*–2*d*) and the respective enable clock lines (5*a*–5*d*), which is connected to the logic gate, are both logic ONE. Furthermore, signals on the enable clock lines (5*a*–5*d*) determine durations of the lengths of time current flows through the heaters in the particular nozzles 1*a*–1*d*. Data for driving the heater driver transistor may be provided from processed image data that is input to a data shift register 6. The latch register 7*a*–7*d*, in response to a latch clock, receives the data from a respective shift register stage and provides a signal on the lines 3*a*–3*d* representative of the respective latched signal (logical ONE or ZERO) representing either that a dot is to be printed or not on a receiver. In the third nozzle, the lines A—A and B—B define the direction in which cross-sectional views are taken.

Figure 1A:
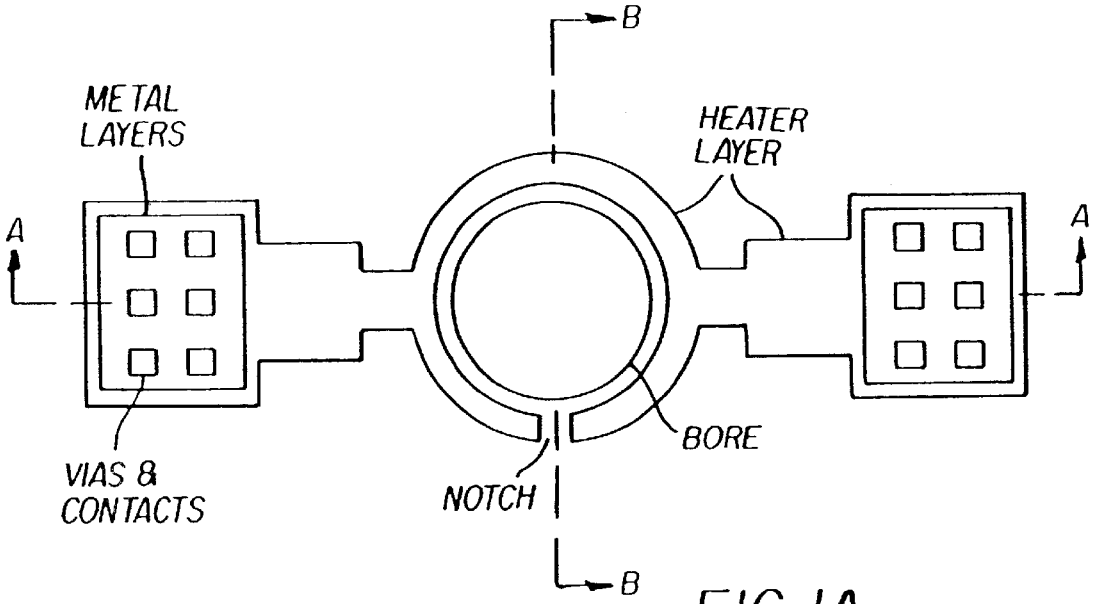
FIG. 1A is a simplified top view of a nozzle with a "notch" type heater for a CIJ print head in accordance with the invention.
Figure 1B:
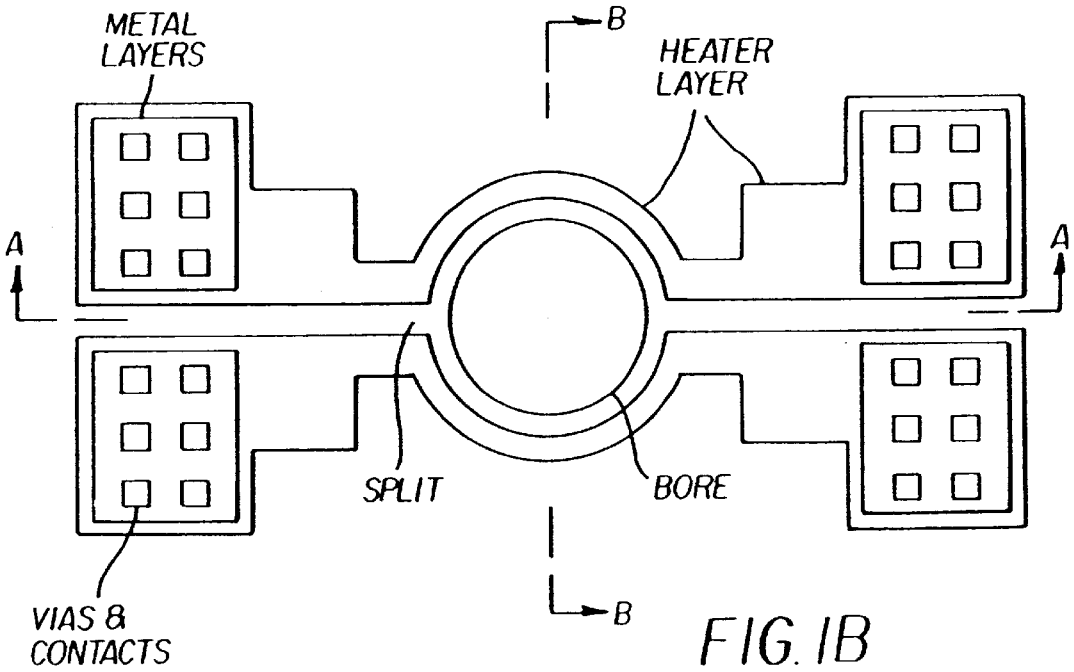
FIG. 1B is a simplified top view of a nozzle with a split type heater for a CIJ print head made in accordance with the invention.

FIGS. 1A and 1B show more detailed top views of the two types of heaters (the "notch type" and "split type" respectively) used in CIJ print heads. They produce asymmetric heating of the jet and thus cause ink jet deflection. Asymmetrical application of heat merely means supplying electrical current to one or the other section of the heater independently in the case of a split type heater. In the case of a notch type heater applied current to the notch type heater will inherently involve an asymmetrical heating of the ink. With reference now to FIG. 1A there is illustrated a top view of an ink jet printhead nozzle with a notched type heater. The heater is formed adjacent the exit opening of the nozzle. The heater element material substantially encircles the nozzle bore but for a very small notched out area, just enough to cause an electrical open. These nozzle bores and associated heater configurations are illustrated as being circular, but can be non-circular as disclosed by Jeanmaire et al. in commonly assigned U.S. application Ser. No. 09/466,346 filed Dec. 17, 1999, the contents of which are incorporated herein by reference. As noted also with reference to FIG. 1 one side of each heater is connected to a common bus line, which in turn is connected to the power supply typically +5 volts. The other side of each heater is connected to a logic AND gate within which resides an MOS transistor driver capable of delivering up to 30 mA of current to that heater. The AND gate has two logic inputs. One is from the Latch 7*a*–*d* which has captured the information from the respective shift register stage indicating whether the particular heater will be activated or not during the present line time. The other input is the enable clock that determines the length of time and sequence of pulses that are applied to the particular heater. Typically there are two or more enable clocks in the printhead so that neighboring heaters can be turned on at slightly different times to avoid thermal and other cross talk effects.

With reference to FIG. 1B, there is illustrated the nozzle with a split type heater wherein there are essentially two semicircular heater elements surrounding the nozzle bore adjacent the exit opening thereof. Separate conductors are provided to the upper and lower segments of each semi circle, it being understood that in this instance upper and lower refer to elements in the same plane. Vias are provided that electrically contact the conductors to metal layers associated with each of these conductors. These metal layers are in turn connected to driver circuitry formed on a silicon substrate as will be described below.

Figure 2:
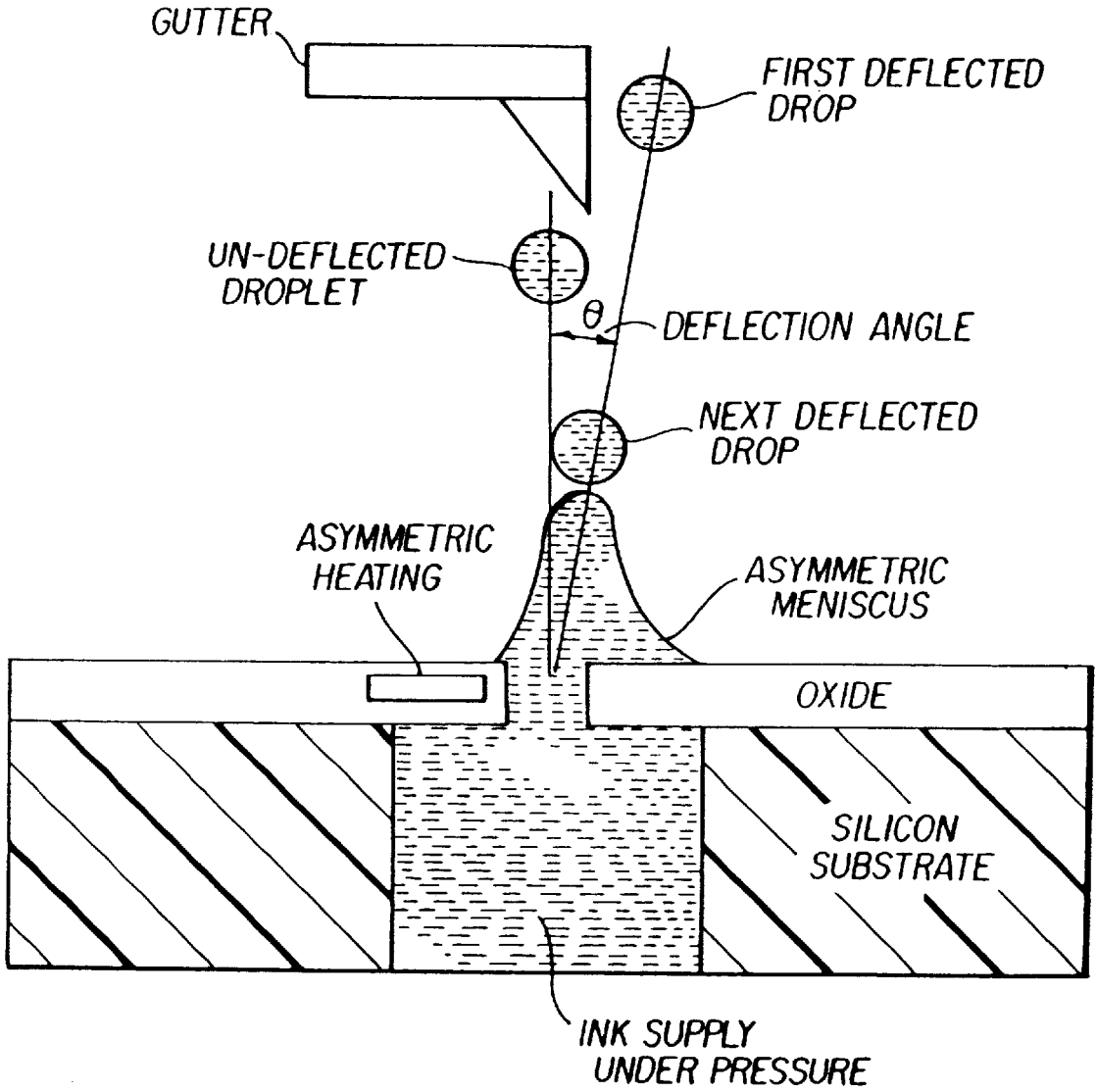
FIG. 2 is cross-sectional view of a nozzle with notch type heater, and illustrating operation of a gutter to capture undeflected droplets.

In FIG. 2, there is shown a simplified cross-sectional view of an operating nozzle which operates to cause droplets to be deflected or not to be deflected. As mentioned above, there is an ink channel formed under the nozzle bores to supply the ink. This ink supply is under pressure typically between 15 to 25 psi for a typical bore diameter of about 8.8 micrometers and using a typical ink with a viscosity of 4 centipoise or less. The ink in the delivery channel emanates from a pressurized reservoir (not shown), leaving the ink in the channel under pressure. This pressure is adjusted to yield the desired velocity for the streams of fluid emanating from the nozzles. The constant pressure can be achieved by employing an ink pressure regulator (not shown). Without any current flowing to the heater, a jet forms that is straight and flows directly into the gutter. On the surface of the printhead a symmetric meniscus forms around each nozzle that is a few microns larger in diameter than the bore. If a current pulse is applied to the heater, the meniscus in the heated side pulls in and the jet deflects away from the heater. The droplets that form then bypass the gutter and land on the receiver. When the current through the heater is returned to zero, the meniscus becomes symmetric again and the jet direction is straight. The device could just as easily operate in the opposite way, that is, the deflected droplets are directed into the gutter and the printing is done on the receiver with the non-deflected droplets. Also, having all the nozzles in a line is not absolutely necessary. It is just simpler to build a gutter that is essentially a straight edge rather than one that has a staggered edge that reflects the staggered nozzle arrangement.

In typical operation, the heater resistance is of the order of 400 ohms for a heater conformal to an 8.8 micrometers diameter bore, the current amplitude is between 10 to 20 mA, the pulse duration is about 2 microseconds and the resulting deflection angle for pure water is of the order of a few degrees, in this regard reference is made to U.S. application Ser. No. 09/221,256, entitled "Continuous Ink Jet Printhead Having Power-Adjustable Multi-Segmented Heaters" and to U.S. application Ser. No. 09/221,342 entitled "Continuous Ink Jet Printhead Having Multi-Segmented Heaters", both filed Dec. 28, 1998.

The application of periodic current pulses causes the jet to break up into synchronous droplets, to the applied pulses. These droplets form about 100 to 200 micrometers away from the surface of the printhead and for an 8.8 micrometers diameter bore and about 2 microseconds wide, 200 kHz pulse rate, they are typically 3 to 4 pL in volume. The drop volume generated is a function of the pulsing frequency, the bore diameter and the jet velocity. The jet velocity is determined by the applied pressure for a given bore diameter and fluid viscosity as mentioned previously. The bore diameter may range from 1 micrometer to 100 micrometers, with a preferred range being 6 micrometers to 16 micrometers. Thus the heater pulsing frequency is chosen to yield the desired drop volume.

Figure 3:
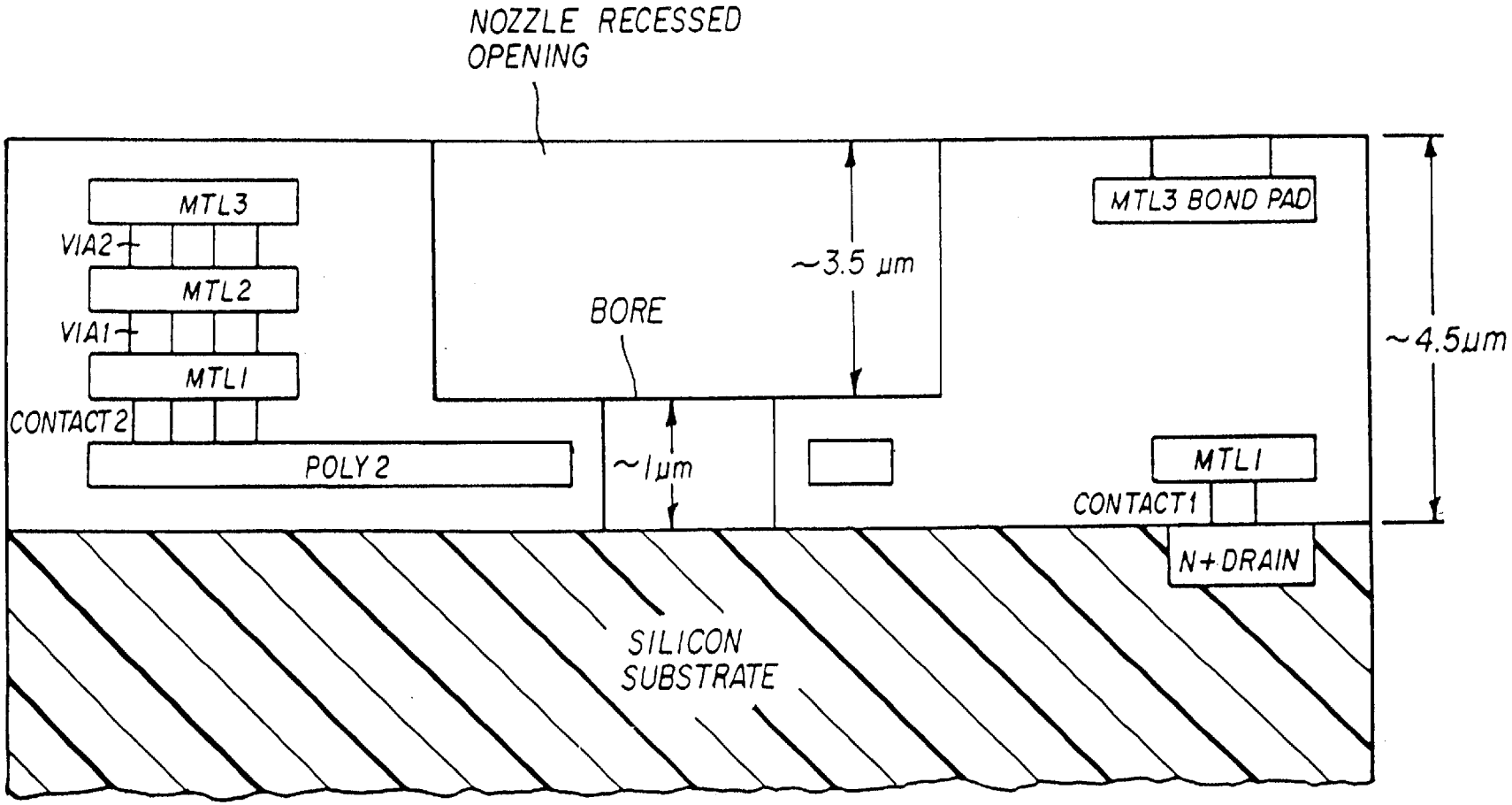
FIG. 3 is a simplified schematic sectional view taken along line A-B of FIG. 1A and illustrating the nozzle area at the end of the fabrication sequence at the VLSI CMOS facility in accordance with the invention.

The cross-sectional view taken along sectional line A—B and shown in FIG. 3 represents an incomplete stage in the formation of a printhead in which ink channels will be formed later on the same silicon substrate that the CMOS circuits are already built.

As was mentioned earlier, the CMOS circuitry is fabricated first on the silicon wafers as one or more integrated circuits. The CMOS process may be a standard 0.5 micrometers mixed signal process incorporating two levels of polysilicon and three levels of metal on a six inch diameter wafer. Wafer thickness is typically 675 micrometers. In FIG. 3, this process is represented by the three layers of metal, shown interconnected with vias. Also polysilicon level 2 and an N+ diffusion and contact to metal layer 1 are drawn to indicate active circuitry in the silicon substrate. Gate electrodes for the CMOS transistor devices are formed from one of the polysilicon layers.

Because of the need to electrically insulate the metal layers, dielectric layers are deposited between them making the total thickness of the film on top of the silicon wafer about 4.5 micrometers.

The structure illustrated in FIG. 3 basically would provide the necessary transistors and logic gates for providing the control components illustrated in FIG. 1. In addition, and in accordance with the invention, the CMOS process also provides a layer of polysilicon as a heater element for asymmetrically heating the ink at a nozzle opening. In addition, a recess over the bore is etched at the same time as the oxide/nitride film over the bond pads are etched and the bores are photolithographically defined and etched subsequently, since such steps are compatible with VLSI CMOS processing.

As a result of the conventional CMOS fabrication steps a silicon substrate of approximately 675 micrometers in thickness and about 6 inches in diameter is provided. Larger or smaller diameter silicon wafers can be used equally as well. A plurality of transistors are formed in the silicon substrate through conventional steps of selectively depositing various materials to form these transistors as is well known. Supported on the silicon substrate are a series of layers eventually forming an oxide/nitride insulating layer that has one or more layers of polysilicon and metal layers formed therein in accordance with desired pattern. Vias are provided between various layers as needed and to the bond pads. The various bond pads are provided to make respective connections of data, latch clock, enable clocks, and power provided from a circuit board mounted adjacent the printhead or from a remote location. Although only one of the bond pads is shown it will be understood that multiple bond pads are formed in the nozzle array. As indicated in FIG. 3 the oxide/nitride insulating layers is about 4.5 micrometers in thickness. The structure illustrated in FIG. 3 basically would provide the necessary interconnects, transistors and logic gates for providing the control components illustrated in FIG. 1, as well as the nozzle structure above the silicon wafer.

Figure 4:
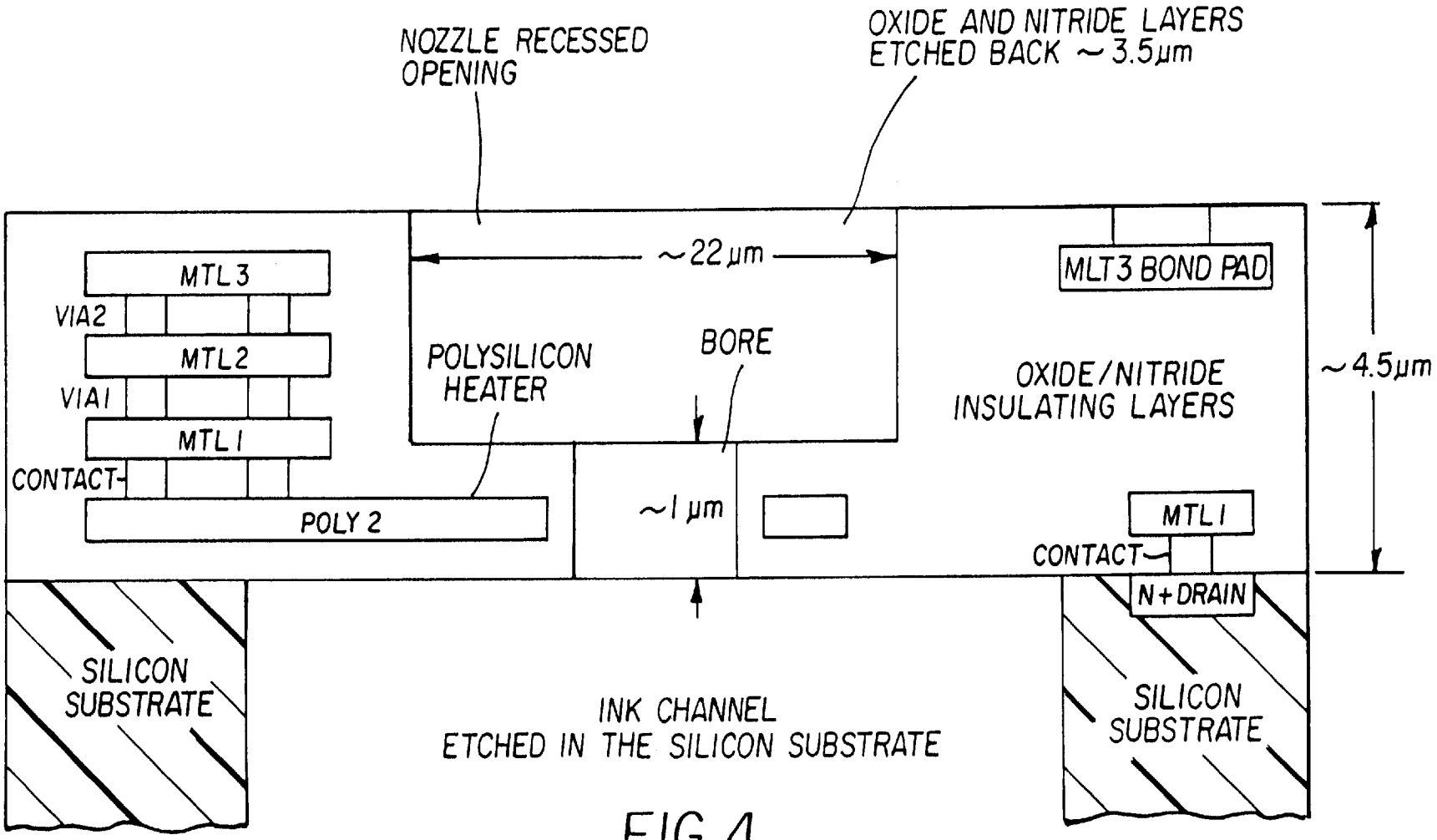
FIG. 4 is a schematic sectional view taken along line A-B of a CMOS compatible nozzle fabricated in accordance with the invention.
Figure 4A:
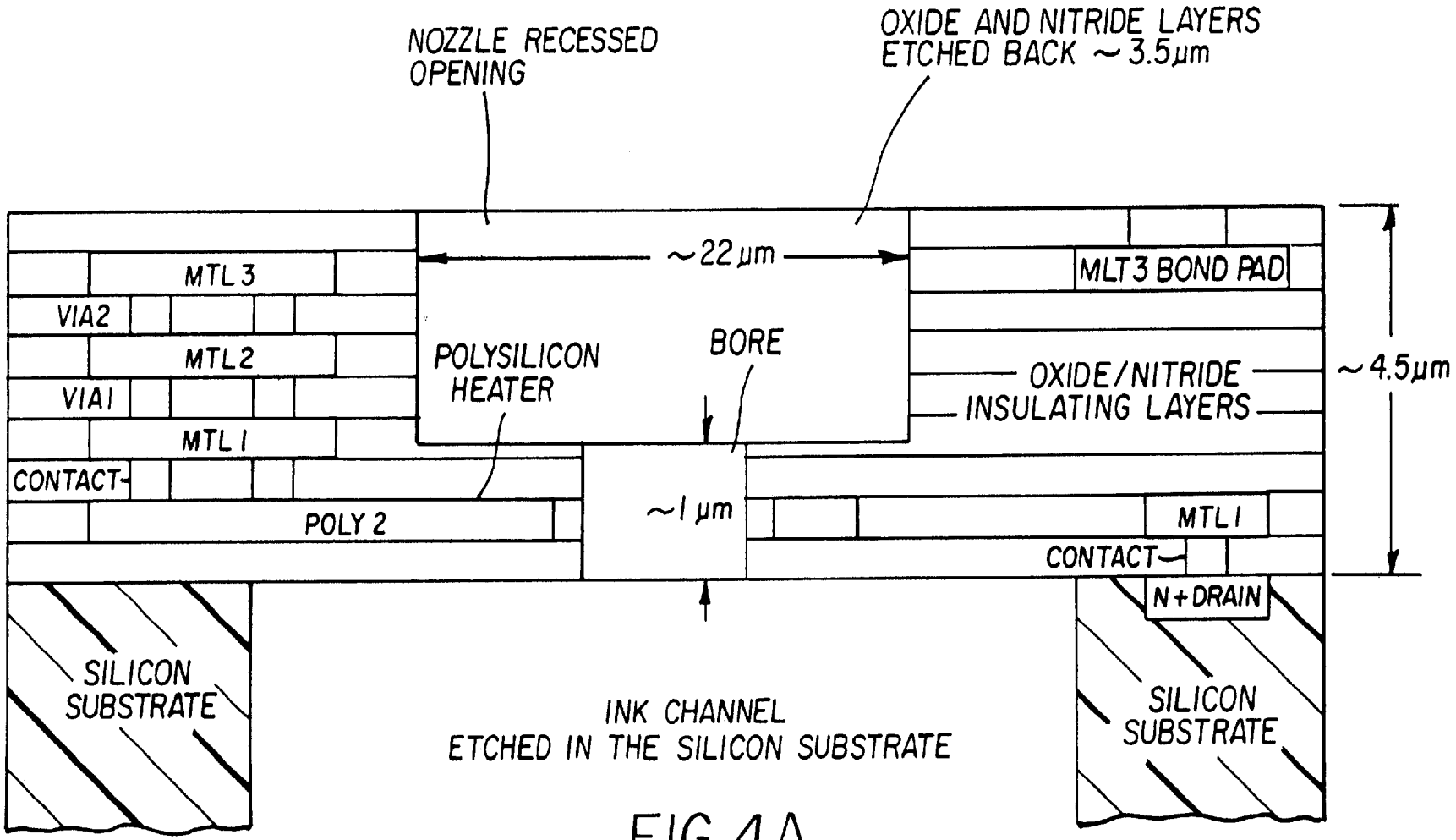
FIG. 4A is a view similar to that of FIG. 4 and showing the layered construction of the oxide/nitride layers as described below.

With reference to FIG. 4, the recessed opening above the bore may have a variety of sizes and shapes depending on the bore diameter and the amount of added resistance and energy dissipation that is tolerable. The added resistance is due to the length of polysilicon that is needed to extend from the metal and via contact area to the heater at the edge of the bore. One shape is a circularly cylindrical recessed opening, so the net effect is that the recessed opening may range in size from 10 micrometers larger in diameter than the bore to 100 micrometers larger in diameter than the bore. Of course, the recessed opening cannot be so large as to impinge upon a neighboring nozzle, nor compromise the integrity of the metal layers and vias. For the typical 8.8 micrometer diameter bore, the recessed opening is typically 22 micrometers in diameter.

Figure 15:
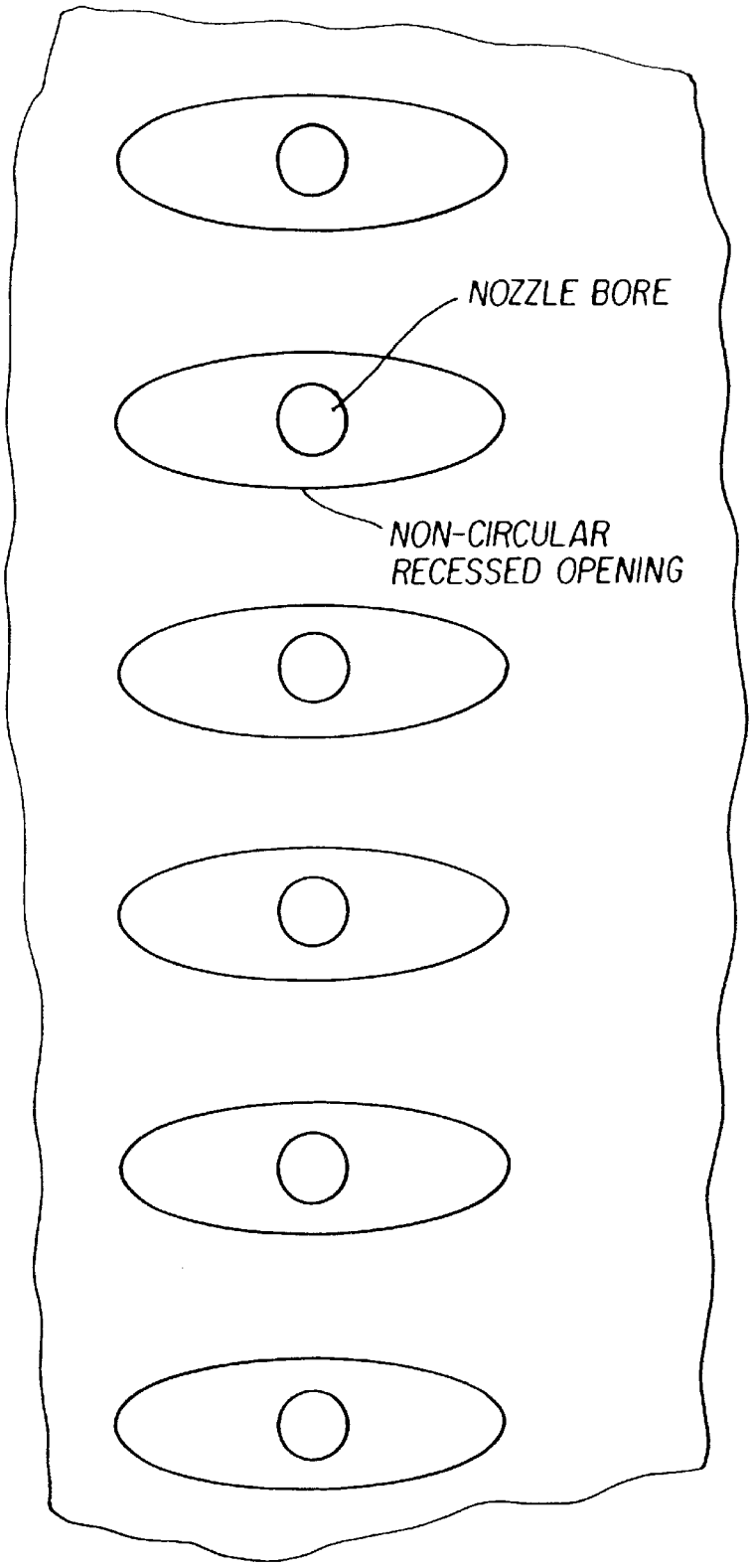
FIG. 15 illustrates a schematic diagram of a series of nozzle bores featuring location of each in a recessed opening in an insulating layer or layers overlying a silicon substrate.

Another embodiment of the invention is one in which is recessed opening is not circular. Referring now to FIG. 15 which is a schematic view from the top of the printhead, the recessed opening is approximately elliptical, and oriented in such away that a line drawn through the center of the ellipse along the longer symmetry direction of the ellipse (longest diameter) is approximately perpendicular to a line drawn through the row of nozzles. In the event of any fluid buildup inside this recessed opening, this elongation of the recessed opening allows more room or volume for such fluid, thus minimizing any impact of such fluid buildup on the performance of the nozzle, yet allows for a high nozzle density along the row of nozzles. Of course, elliptical is but one of a number of elongated, yet symmetrical, shapes for this recessed opening, and thus the specification of the ellipse is not meant as a limitation to the shape of the recessed opening.

Regardless of the shape of the recessed opening, the depth of the recessed opening is typically about 3.5 micrometers deep resulting in a bore membrane thickness that is typically 1.0 micrometers. This recessed bore opening may range from 1 micrometer deep to 3.5 micrometers deep leaving a bore membrane thickness that may range from 3.5 micrometers think to 1 micrometer thick, respectively. It will be understood of course that along the silicon array many nozzle bores are simultaneously etched. The embedded heater element effectively surrounds each nozzle bore and is proximate to the nozzle bore which reduces the temperature requirement of the heater for heating ink drops in the bore.

At this point, the silicon wafers are taken out of the CMOS facility. First, they are thinned from their initial thickness of 675 micrometers to about 300 micrometers. A mask to open ink channels is then applied to the backside of the wafers and the silicon is etched in an STS etcher, all the way to the front surface of the silicon. Alignment of the ink channel openings in the back of the wafer to the nozzle array in the front of the wafer may be provided with an aligner system such as the Karl Suss 1X aligner system.

Figure 5:
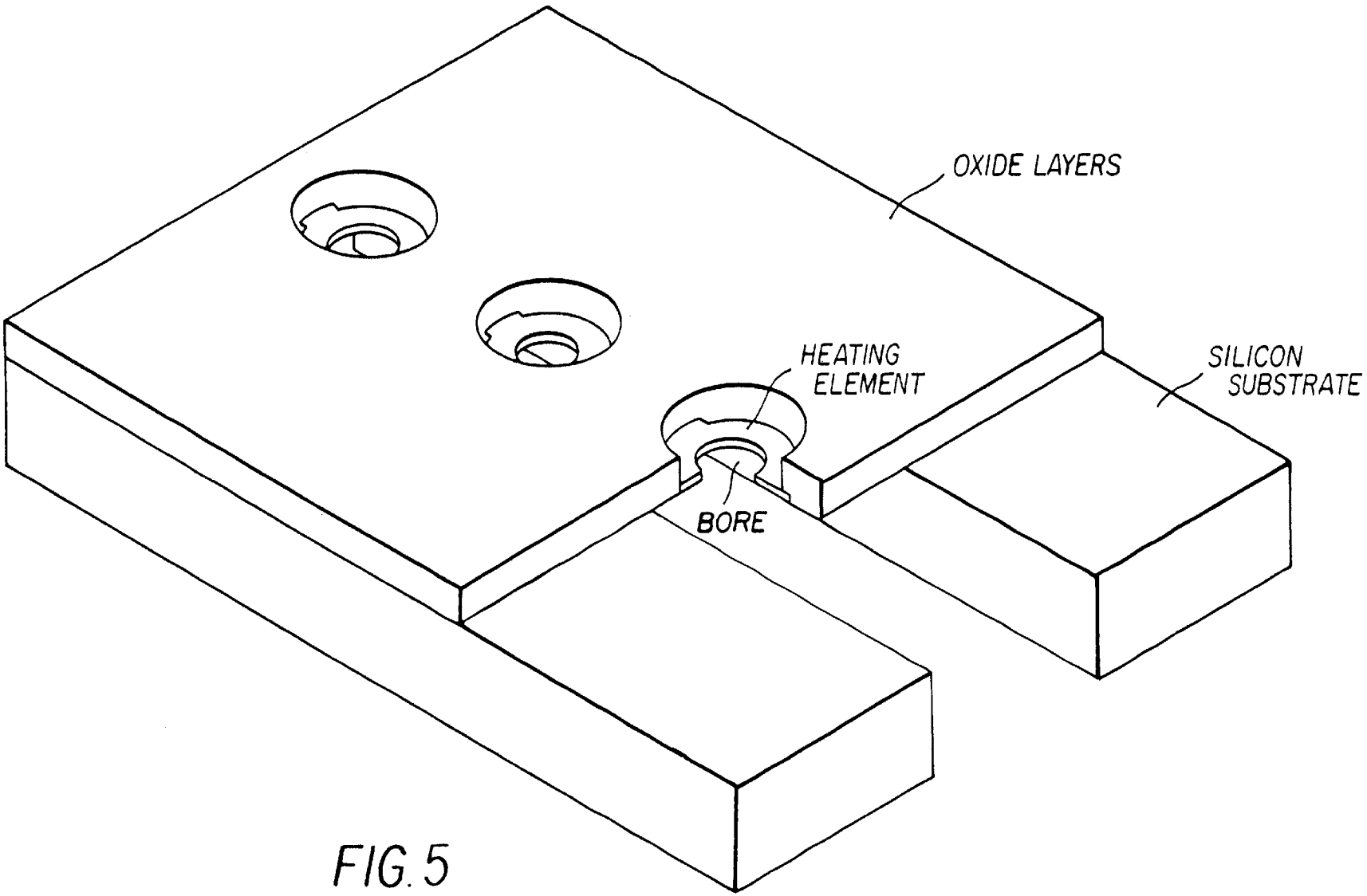
FIG. 5 is a schematic perspective view of the nozzle illustrated in FIG. 4 and illustrating a central channel which extends through the silicon substrate.
Figure 6:
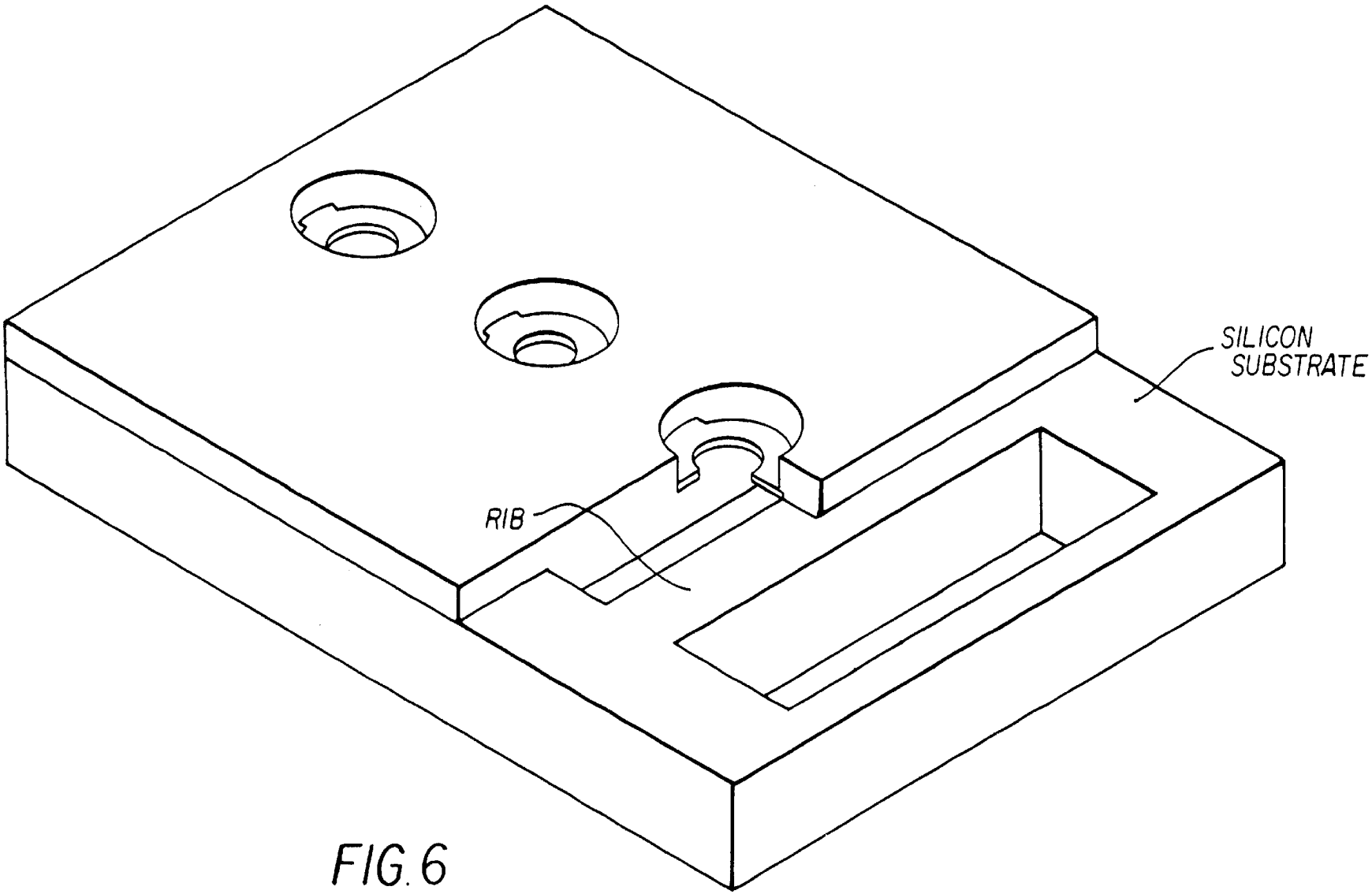
FIG. 6 is a view similar to that of FIG. 5 but illustrating rib structures formed in the silicon wafer that separate each nozzle and which provide increased structural strength and reduce wave action in the ink channel.
Figure 7:
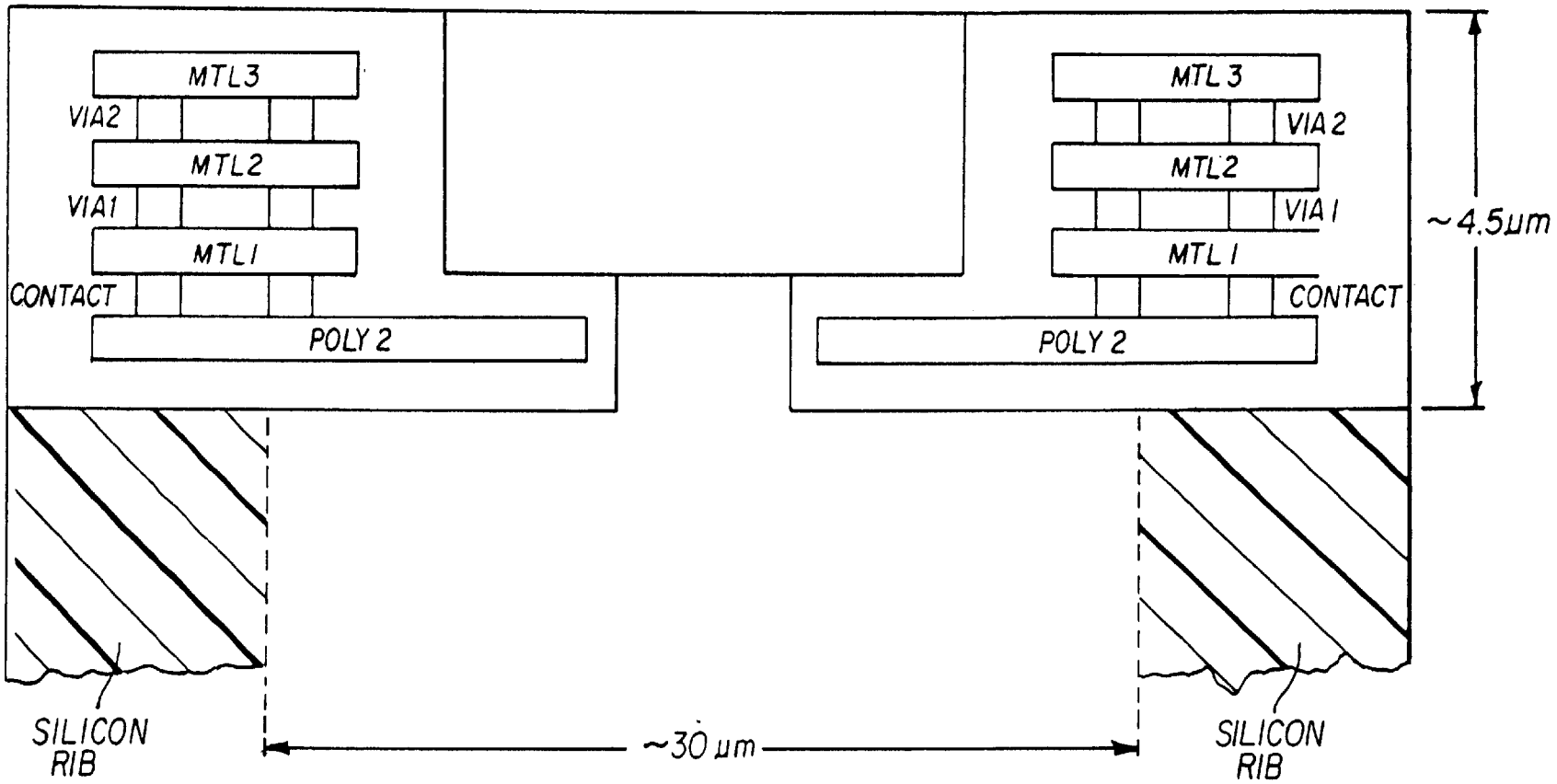
FIG. 7 is a view similar to that of FIG. 4 but illustrating the rib structures formed in the silicon wafer as illustrated in FIG. 6.
Figure 8:
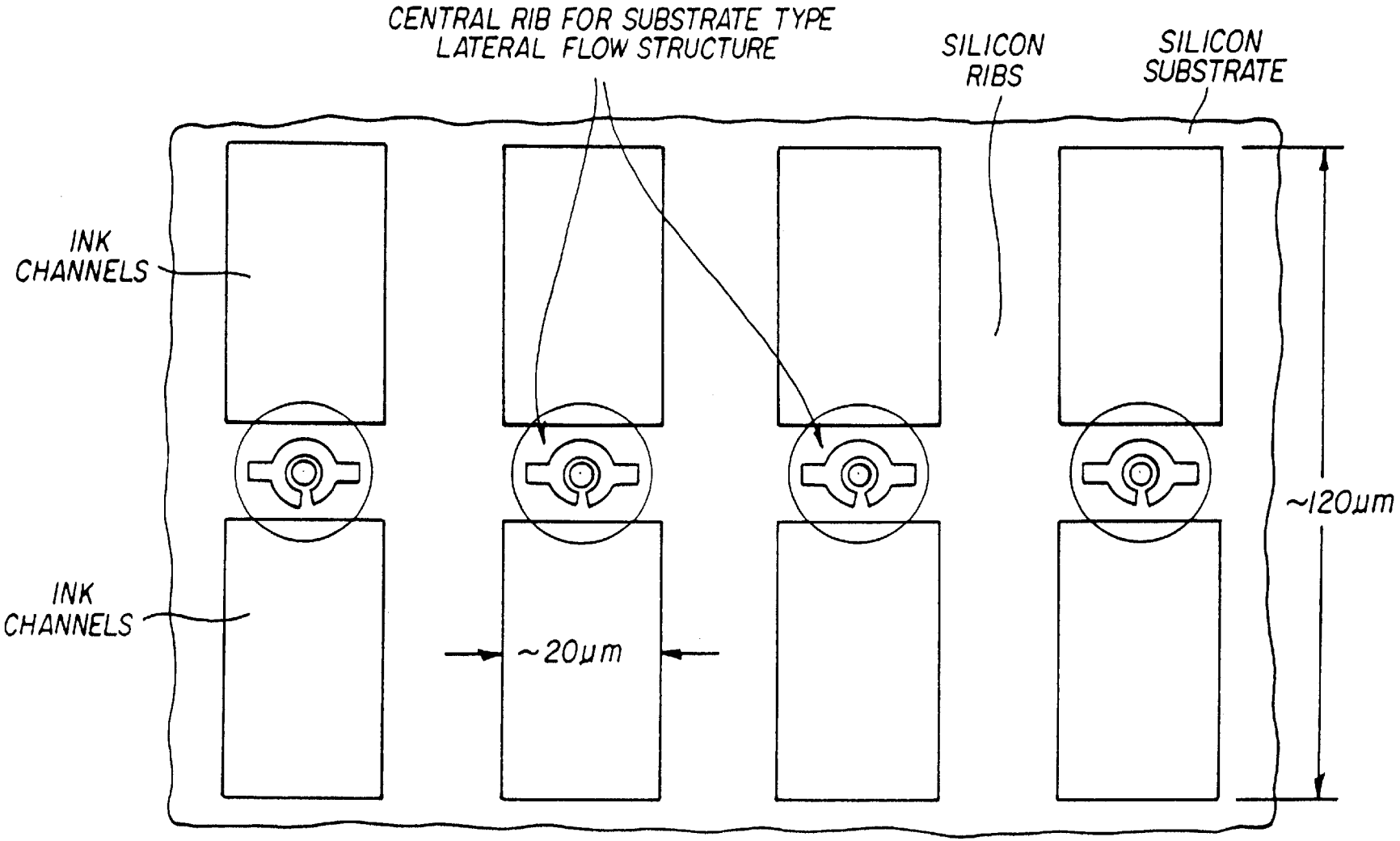
FIG. 8 is a simplified representation of the top view of an ink jet print head with a small array of nozzles illustrating the concept of silicon ribs being provided in ink channels between adjacent nozzles and a silicon substrate type lateral flow blocking structure in accordance with another embodiment of the invention. The rib structure and blocking structure are not actually visible in this view, but are shown for illustrative purposes.

With reference to FIG. 5 the ink channel formed in the silicon substrate is illustrated as being a rectangular cavity passing centrally beneath the nozzle array. However, a long cavity in the center of the die tends to structurally weaken the printhead array so that if the array were subject to torsional stresses, such as during packaging, the membrane could crack. Also, along printheads, pressure variations in the ink channels due to low frequency pressure waves can cause jet jitter. Description will now be provided of an improved design. This improved design is one that will leave behind a silicon bridge or rib between each nozzle of the nozzle array during the etching of the ink channel. These bridges extend all the way from the back of the silicon wafer to the front of the silicon wafer. The ink channel pattern defined in the back of the wafer, therefore, is thus not a long rectangular recess running parallel to the direction of the row of nozzles but is instead a series of smaller rectangular cavities each feeding a single nozzle, see FIGS. 6 and 7. The use of these ribs improves the strength of the silicon as opposed to the long cavity in the center of the die which as noted above would tend to structurally weaken the printhead. The ribs or bridges also tend to reduce pressure variations in the ink channels due to low frequency pressure waves which as noted above can cause jet jitter. In this example each ink channel is fabricated to be a rectangle of 20 micrometers along the direction of the row of nozzles and 120 micrometers in the direction transverse and preferably orthogonal to the row of nozzles.

As noted above in a CIJ printing system it is desirable that jet stream deflection could be further increased by increasing the portion of ink entering the bore of the nozzle with lateral rather than axial momentum components. Such can be accomplished by blocking some of the fluid having axial momentum by building a block in the center of each nozzle element just below the nozzle bore.

In accordance still another embodiment of the invention a method of constructing of a nozzle array with a ribbed structure as described above but also featuring a lateral flow structure will now be described with reference to FIGS. 8–12.

Figure 10:
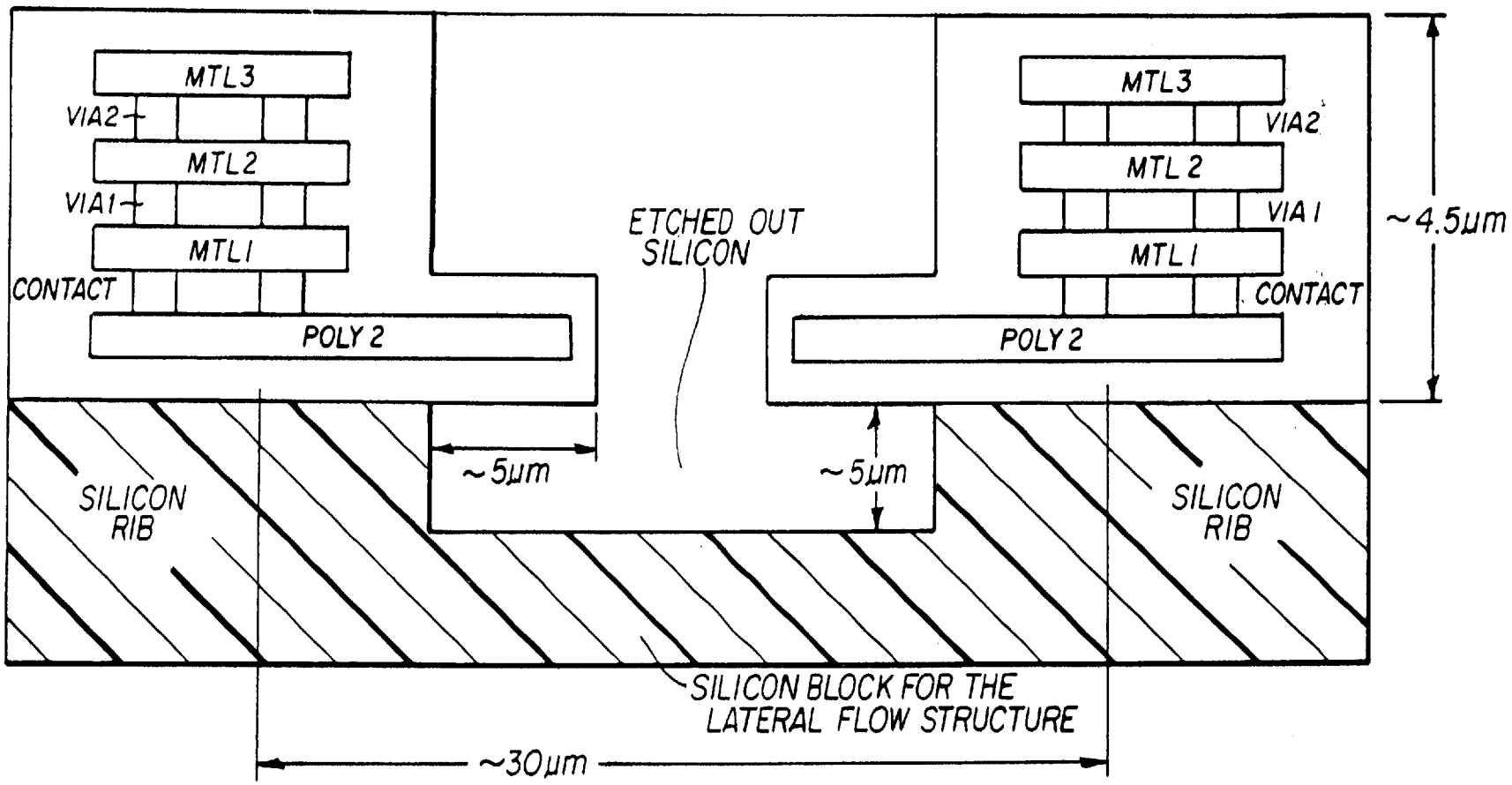
FIG. 10 is a schematic sectional view taken along the line A—A in the nozzle area of FIG. 1A after the further definition of the silicon blocking structure for lateral flow in accordance with the embodiment illustrated in FIG. 9.
Figure 11:
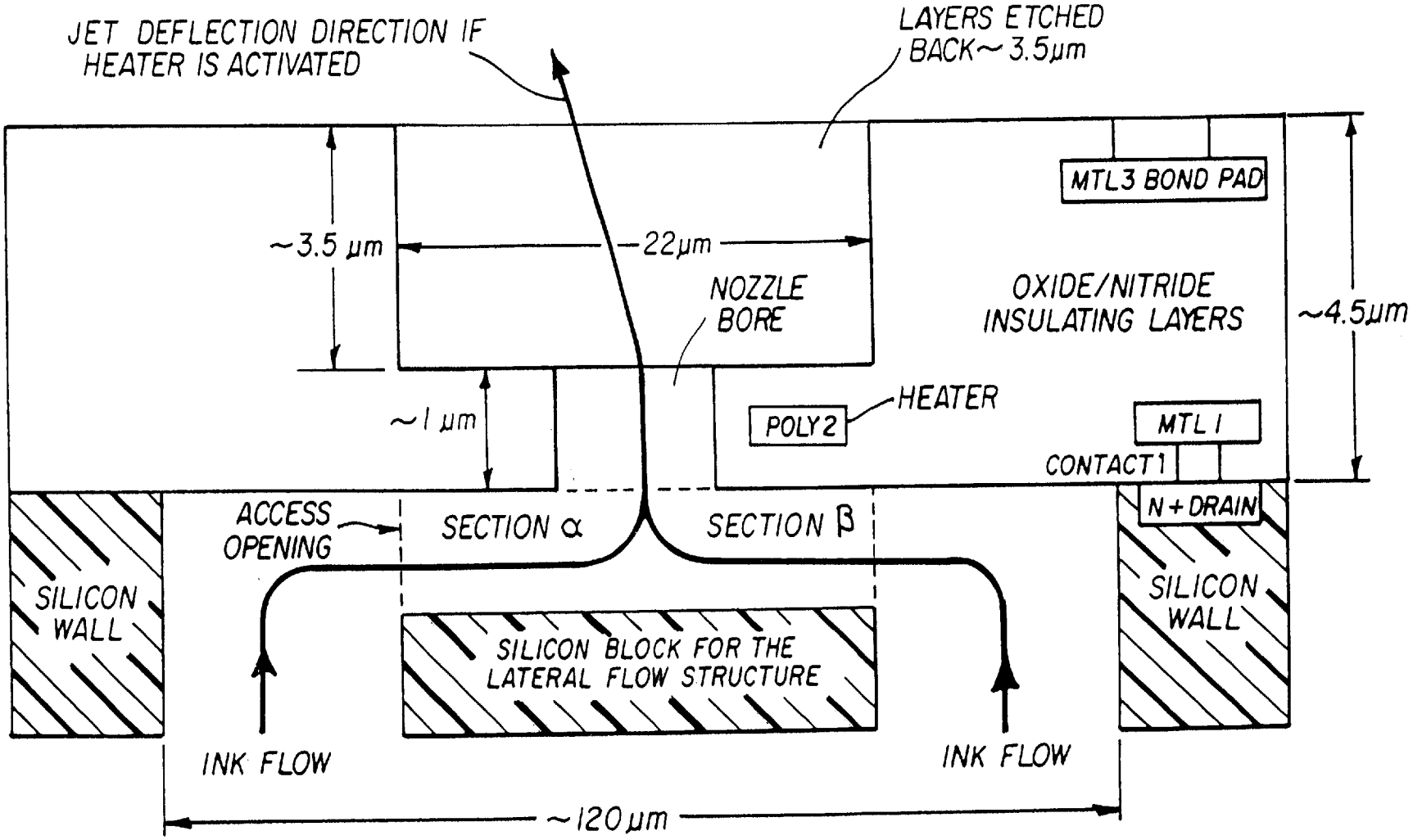
FIG. 11 is a schematic cross-sectional view taken along line B—B in the nozzle area of FIG. 1A after the definition of the silicon block for lateral flow and using a "footing" effect for removing silicon at the top of the blocking structure.

With reference now to FIG. 10, the cross-sectional view taken along sectional line A—A shows the lateral flow blocking structure and silicon ribs. A cross-sectional view taken along sectional line B—B is illustrated in FIG. 11. In a first method of forming the silicon blocking structure reliance is provided upon a phenomenon of the STS etcher called "footing." Accordingly, when the silicon etch has reached the silicon/silicon dioxide interface, high speed lateral etching occurs because of charging of the oxide and deflection of the impinging reactive silicon etching ions laterally. This rapid lateral etch extends about 5 micrometers. The wafers are then placed in a conventional plasma etch chamber and the silicon in the center of the bore is etched anistropically down for a distance that may range from about 3 micrometers to about 6 micrometers, with the typical amount being about 5 micrometers down. FIGS. 10 and 11 show cross-sectional views of the resulting structure. Note that in FIG. 11, the cross-hatched area represents the silicon that has been removed to provide an access opening between a primary ink channel formed in the silicon substrate and the nozzle bore.

A second method is one that does not depend on the footing effect. Instead, the silicon in the bore is etched isotropically from the front of the wafer for a distance that may range from about 3 micrometers to about 6 micrometers, with the typical amount being about 5 micrometers. The isotropic etch then removes the silicon laterally as well as vertically eventually removing the silicon shown in cross-section in FIG. 12 thus facilitating fluidic contact between the ink channel and the bore. In this approach, the blocking structure is shorter reflecting the etch back from the top fabrication method, which removes the cross-hatched region of silicon.

Figure 12:
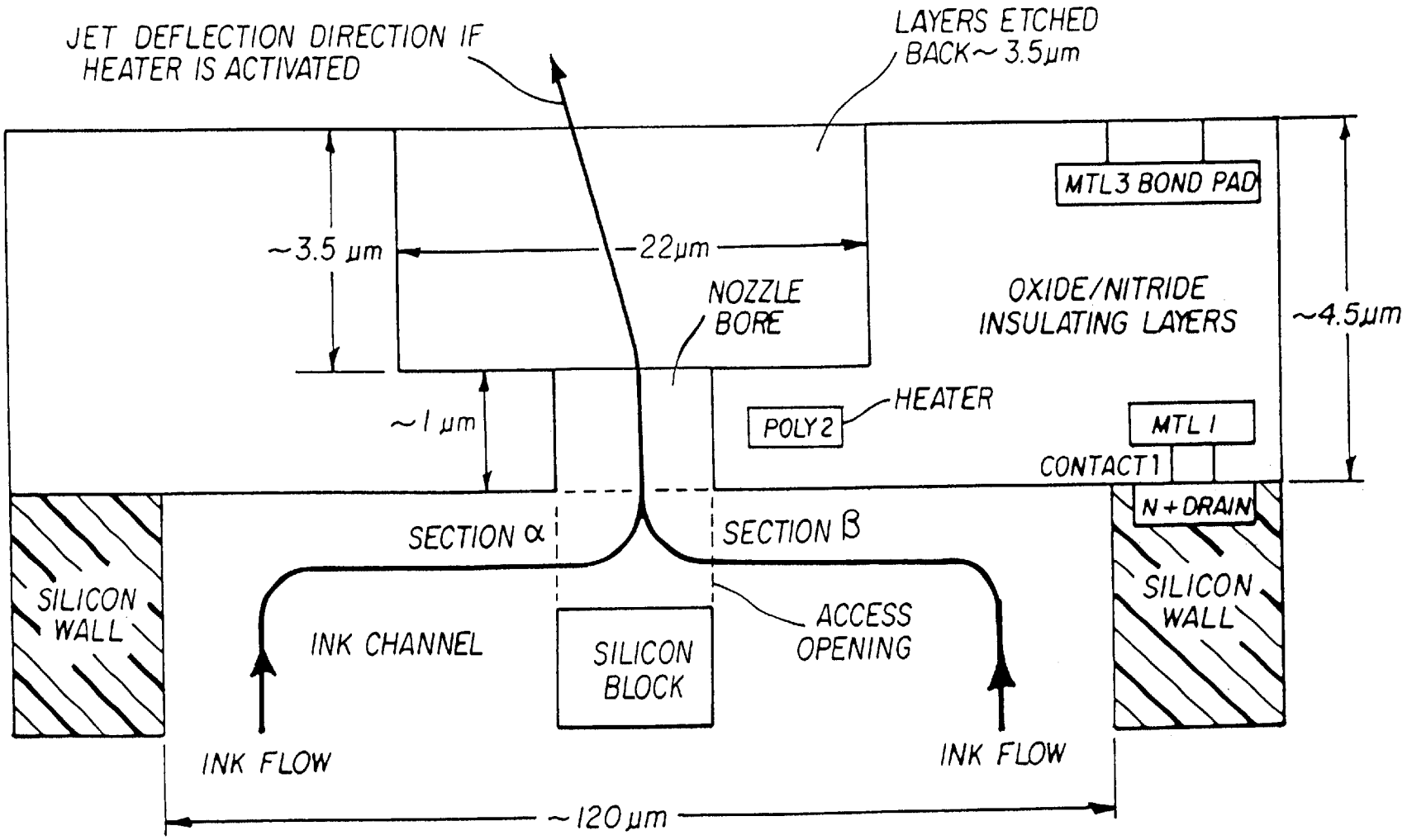
FIG. 12 is a schematic cross-sectional view taken along line B—B in the nozzle area after the definition of the silicon block used for lateral flow and using a top fabrication method.

As shown schematically in FIGS. 11 and 12, the ink flowing into the bore is dominated by lateral momentum components, which is what is desired for increased droplet deflection. In the above described etching processes, alignment of the ink channel openings in the back of the wafer to the nozzle array in the front of the wafer may be provided with an aligner system such as the Karl Suss aligner.

Figure 9:
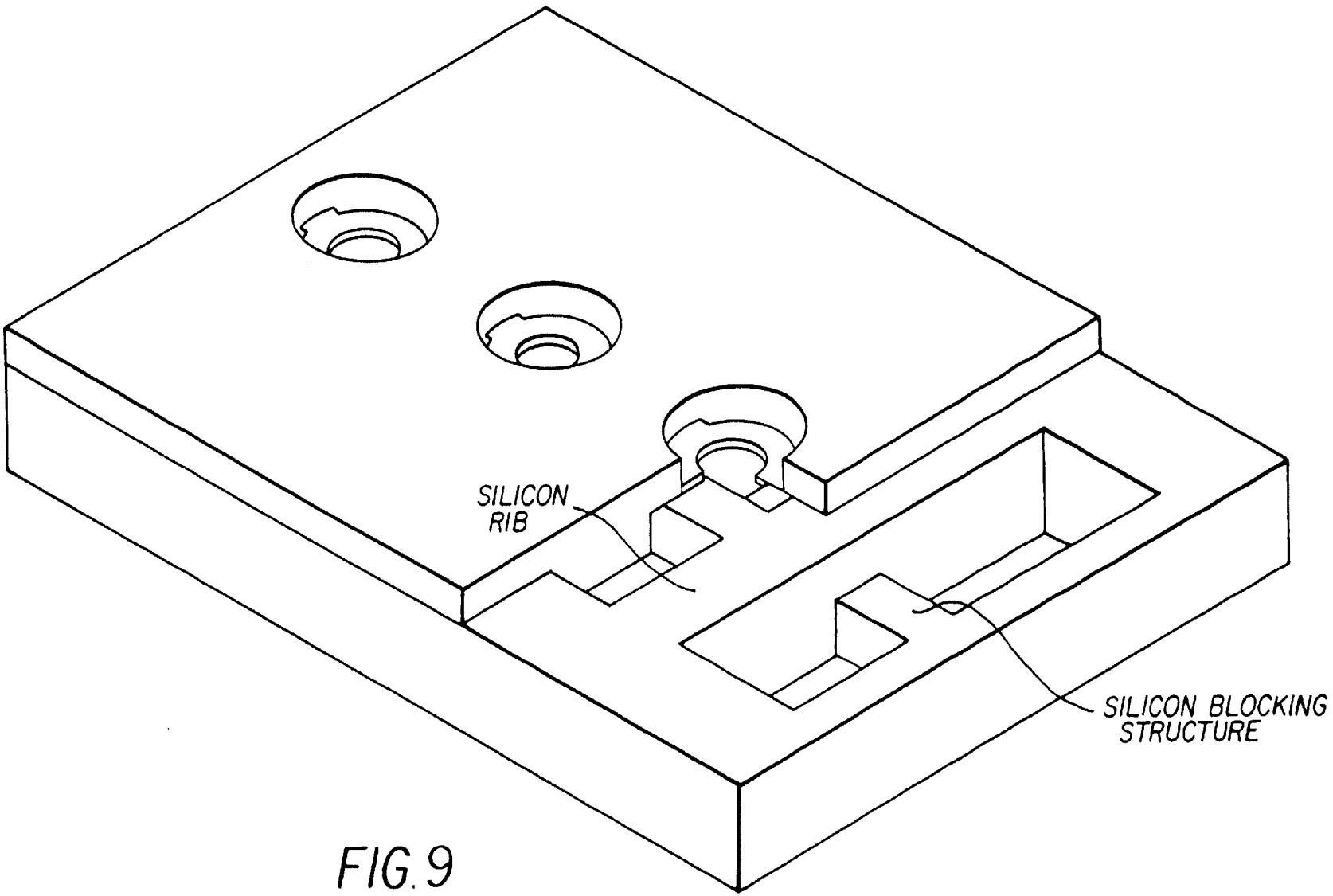
FIG. 9 is a schematic perspective view of the embodiment shown in FIG. 8 and illustrating an ink jet print head with silicon rib structures and silicon lateral flow blocking structure.

In FIG. 9, there is provided a perspective view of the nozzle array with silicon based blocking structure showing the oxide/nitride layer partially removed to illustrate the blocking structure beneath the nozzle bore. The nozzle bore is spaced from the top of the blocking structure by an access opening. As may be seen in FIGS. 11, 12 the blocking structure formed in the silicon substrate causes the ink which is under pressure in the ink cavity to flow about the blocking structure and to develop lateral momentum components. These lateral momentum components can be made unequal by the application of asymmetric heating and this then leads to stream deflection, as is shown in FIGS. 11 and 12.

It will be understood, of course, that although the above description is provided relative to formation of a single nozzle that the process is simultaneously applicable to a whole series of nozzles formed in a row along the wafer. This row may be either a straight line or less preferably a staggered line.

The polysilicon heaters contribute to reducing the viscosity of the ink asymmetrically. Thus as illustrated in FIGS. 11 and 12, ink flow passing through the access opening at the left side of the blocking structure will be heated while ink flow passing through the access opening at the right side of the blocking structure will not be heated. This asymmetric preheating of the ink flow tends to reduce the viscosity of ink having the lateral momentum components desired for deflection and because more ink will tend to flow where the viscosity is reduced there is a greater tendency for deflection of the ink in the desired direction; i.e. away from the heating elements adjacent the bore.

As shown schematically in FIGS. 11 and 12, the ink flowing into the bore is dominated by lateral momentum components, which is what is desired for increased droplet deflection. The access openings require ink to flow under pressure between the channel and the nozzle opening or bore and thus the ink develops lateral flow components because direct axial access to the secondary ink channel is effectively blocked by the silicon block.

Thus, in accordance with the invention polysilicon or other suitable material for service as a heater element and which can be processed and defined during the CMOS processing of the integrated circuits can be used as the heater elements for asymmetric heating of the ink stream in a continuous ink jet printer. This allows for a minimum of post processing; i.e. during the MEMS process no heater elements or nozzle openings need be formed on the printhead since these have been previously defined during the CMOS processing. The use of polysilicon heaters as opposed to TiN heater elements which might be added during MEMS processing allows for a higher temperature operation of the heater elements and thereby provides more potential for deflection of the ink stream which is an important consideration in the design of a continuous ink jet printer.

Figure 14:
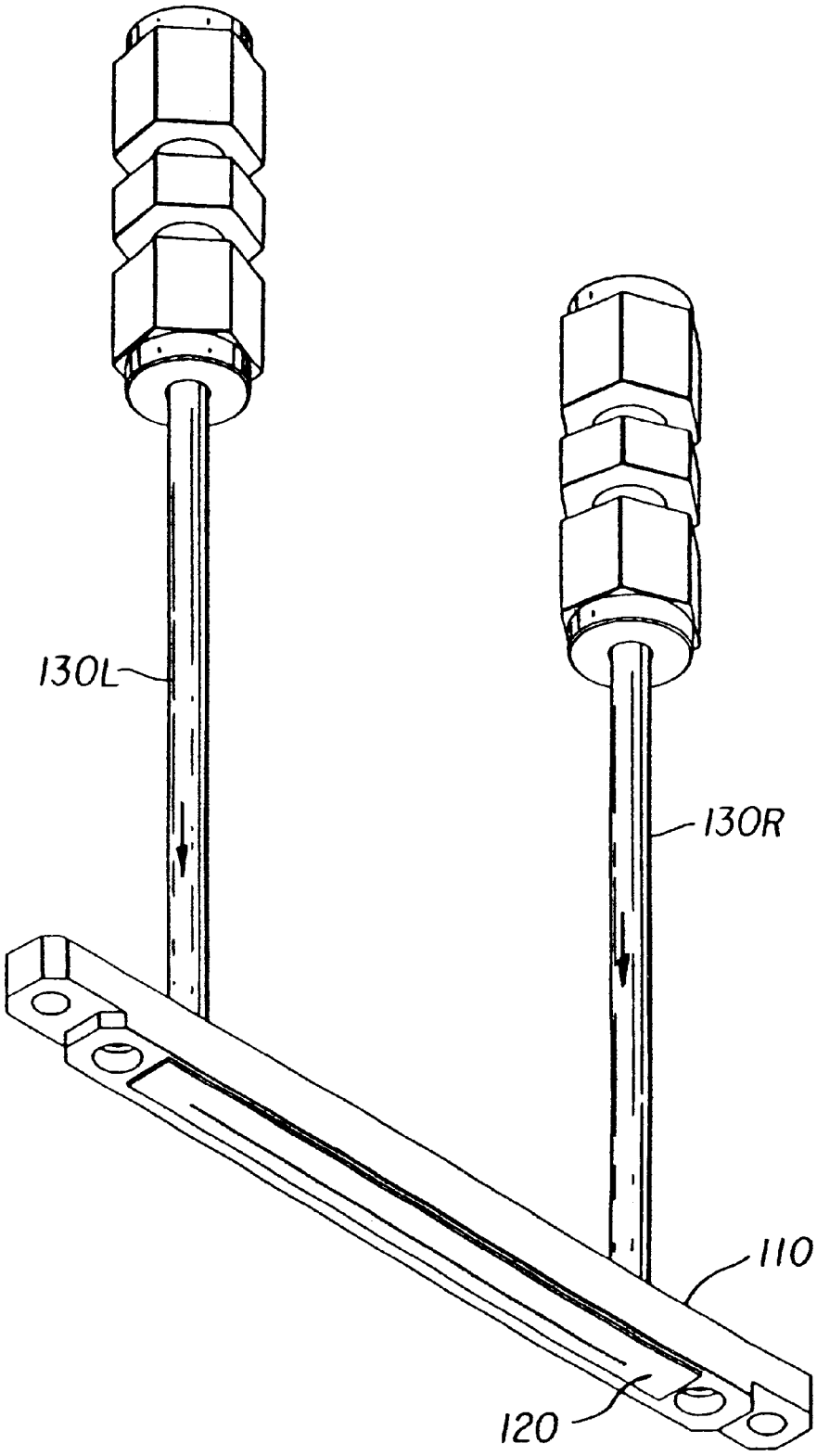
FIG. 14 is a perspective view of the CMOS/MEMS printhead formed in accordance with the invention and mounted on a supporting member into which ink is delivered.

With reference to FIG. 14 the completed CMOS/MEMS print head 120 corresponding to any of the embodiments described herein is mounted on a supporting mount 110 having a pair of ink feed lines 130L, 130R connected adjacent end portions of the mount for feeding ink to ends of a longitudinally extending channel formed in the supporting mount. The channel faces the rear of the print head 120 and is thus in communication with the array of ink channels formed in the silicon substrate of the print head 120. The supporting mount, which could be a ceramic substrate, includes mounting holes at the ends for attachment of this structure to a printer system.

Although the present invention has been described with particular reference to various preferred embodiments, the invention is not limited to the details thereof. Various substitutions and modifications will occur to those of ordinary skill in the art, and all such substitutions and modifications are intended to fall within the scope of the invention as defined in the appended claims.

What is claimed is:

1. An ink jet print head comprising:

a silicon substrate including an integrated circuit formed therein for controlling operation of the print head, the silicon substrate having one or more ink channels formed therein along the substrate;

an insulating layer or layers overlying the silicon substrate, the insulating layer or layers having a series of ink jet nozzle bores each formed in a respective recess of the insulating layer or layers, the recess being formed by an etching or other material depletion process and each bore communicates with an ink channel; and each bore having located proximate thereto a heater element formed prior to the material depletion process for forming the recess so that upon forming the recess each heater element is covered by material from the insulating layer or layers.

2. The ink jet print head of claim 1 wherein the insulating layer or layers includes a series of vertically separated levels of electrically conductive leads and electrically conductive vias connect at least some of said levels.

3. The ink jet print head of claim 1 wherein the heater elements are formed of polysilicon.

4. The ink jet print head of claim 1 wherein the insulating layer or layers is formed of an oxide.

5. The ink jet print head of claim 1 wherein the integrated circuit includes CMOS devices.

6. The ink jet print head of claim 1 and wherein a gutter is provided and in a position to collect droplets not selected for printing.

7. The ink jet print head of claim 1 and wherein the recess forms a thin membrane through which the nozzle bore extends, and the membrane overlies the ink channel, and the membrane is from 1 micrometer to 3.5 micrometers in thickness.

8. The ink jet print head of claim 1 and wherein the recess is elliptical in configuration.

9. The ink jet print head of claim 8 and wherein the recesses are arranged in a row and a largest diameter of the elliptical recess is perpendicular to the row.

10. The ink jet print head of claim 8 and wherein the bore has a diameter in the range of 6 micrometers to 16 micrometers and the recess has a diameter that is larger than the bore diameter by 10 micrometers to 100 micrometers larger.

11. The ink jet print head of claim 1 wherein the insulating layer or layers includes a series of vertically separated levels of electrically conductive leads and electrically conductive vias connect at least some of said levels and each heater element is formed of polysilicon in a respective one of the recesses and each heater element is connected to signals generated by the integrated circuit device in said substrate.

12. The ink jet print head of claim 11 wherein the integrated circuit includes CMOS devices.

13. The ink jet print head of claim 12 and wherein a gutter is provided and positioned to collect droplets not selected for printing.

14. The ink jet print head of claim 13 and wherein the silicon substrate has one or more ink channels formed therein along the substrate and each bore communicates with an ink channel.

15. The ink jet print head of claim 14 and wherein plural channels are provided in the silicon substrate.

16. The ink jet print head of claim 15 and wherein the heater element includes a notch for asymmetric heating of ink in the bore.

17. A method of operating a continuous ink jet print head comprising:

providing liquid ink under pressure in an ink channel formed in a silicon substrate, the substrate having an integrated circuit formed therein for controlling operation of the print head;

asymmetrically heating the ink at selected nozzle openings to affect deflection of ink droplet(s), each nozzle opening communicating with an ink channel and the nozzle openings being arranged as an array extending in a predetermined direction; and wherein each nozzle opening is formed in a respective recess in an insulating layer or layers covering the silicon substrate and a heater element is associated with each nozzle opening and located in the recess, the recess being formed by an etching or other material depletion process and the heater element is formed prior to the material depletion process for forming the recess so that upon forming the recess each heater element is covered by material from the insulating layer or layers.

18. The method according to claim 17 and wherein a gutter collects ink droplets not selected for printing.

19. The method according to claim 18 and wherein signals from the integrated circuit are communicated to the heater elements for controlling operation of the heater elements.

20. The method of claim 19 wherein the integrated circuit includes CMOS devices.

21. The method of claim 20 wherein the insulating layer or layers includes a series of vertically separated levels of electrically conductive leads and electrically conductive vias connect at least some of the levels and signals are transmitted from the CMOS devices formed in the substrate through the electrically conductive vias.

22. The method of claim 21 wherein the heater elements are polysilicon and polysilicon in the insulating layer or layers is also used as gate electrodes for CMOS devices formed in the silicon substrate.

23. The method of claim 22 wherein the recess forms a thin membrane through which the nozzle opening extends, and the membrane overlies the ink channel, and the membrane is from 1 micrometer to 3.5 micrometers in thickness.

24. The method of claim 23 wherein the nozzle opening has a diameter in the range of 6 micrometers to 16 micrometers and the respective recess has a diameter that is larger than the bore diameter by 10 micrometers to 100 micrometers larger.

25. The method of claim 17 wherein the recess forms a thin membrane through which the nozzle opening extends, and the membrane overlies the ink channel, and the membrane is from 1 micrometer to 3.5 micrometers in thickness.

26. The method of claim 25 wherein the nozzle opening has a diameter of between 6 micrometers and 16 micrometers.

27. The method of claim 26 wherein the recess is elliptical in configuration.

28. The method of claim 27 wherein the recesses are arranged in a row and a largest diameter of the elliptical recess is perpendicular to the row.

29. The method of claim 17 wherein the nozzle opening has a diameter in the range of 6 micrometers to 16 micrometers and the respective recess has a diameter that is larger than the bore diameter by 10 micrometers to 100 micrometers larger.

* * * * *